United States Patent [19]

Levene et al.

[11] Patent Number: 4,852,439

[45] Date of Patent: Aug. 1, 1989

[54] VACUUM DIE CUTTING METHOD AND APPARATUS

[76] Inventors: Martin M. Levene, 53 Rusholme Rd., Kitchener, Ontario, N2M 2T5; William W. Lessard, 141 Cornell Ave., Kitchener, Ontario, both of Canada, N2G 3E5

[21] Appl. No.: 107,747

[22] Filed: Oct. 13, 1987

[51] Int. Cl.[4] ..... B26D 7/02

[52] U.S. Cl. ..... 83/19; 83/29; 83/139; 83/176; 83/451; 269/21

[58] Field of Search ..... 83/19, 29, 176, 451, 83/648, 684, 694, 139; 269/20–22

[56] References Cited

U.S. PATENT DOCUMENTS

| | | | |
|---|---|---|---|
| 3,777,604 | 12/1973 | Gerber | 83/451 X |
| 4,312,254 | 1/1982 | Pearl | 83/451 X |
| 4,543,862 | 10/1985 | Levene et al. | 83/19 |
| 4,672,870 | 6/1987 | Levene et al. | 83/19 |

FOREIGN PATENT DOCUMENTS 2164889 12/1987 United Kingdom .

*Primary Examiner*—Frank T. Yost
*Assistant Examiner*—Hien H. Phan
*Attorney, Agent, or Firm*—Krass & Young

[57] ABSTRACT

A stationary steel rule cutting die for cutting a fixed pattern in each of a plurality of stacked compressible material layers according to the shape of the steel rule die and including a vacuum system for reducing the stacked height of the compressible material layers prior to cutting. The die assembly includes an enclosure comprising an upper wall and collapsible side walls extending downwardly from the upper wall. The enclosure is positioned over the stacked compressible material layers with the lower peripheral edges of the side walls of the enclosure coacting with an upwardly facing, closed loop sealing surface defined on the steel rule cutting die to define a sealed chamber from which air is exhausted to collapse the side walls of the enclosure and compress the material layers prior to cutting.

22 Claims, 4 Drawing Sheets

FIG. 7
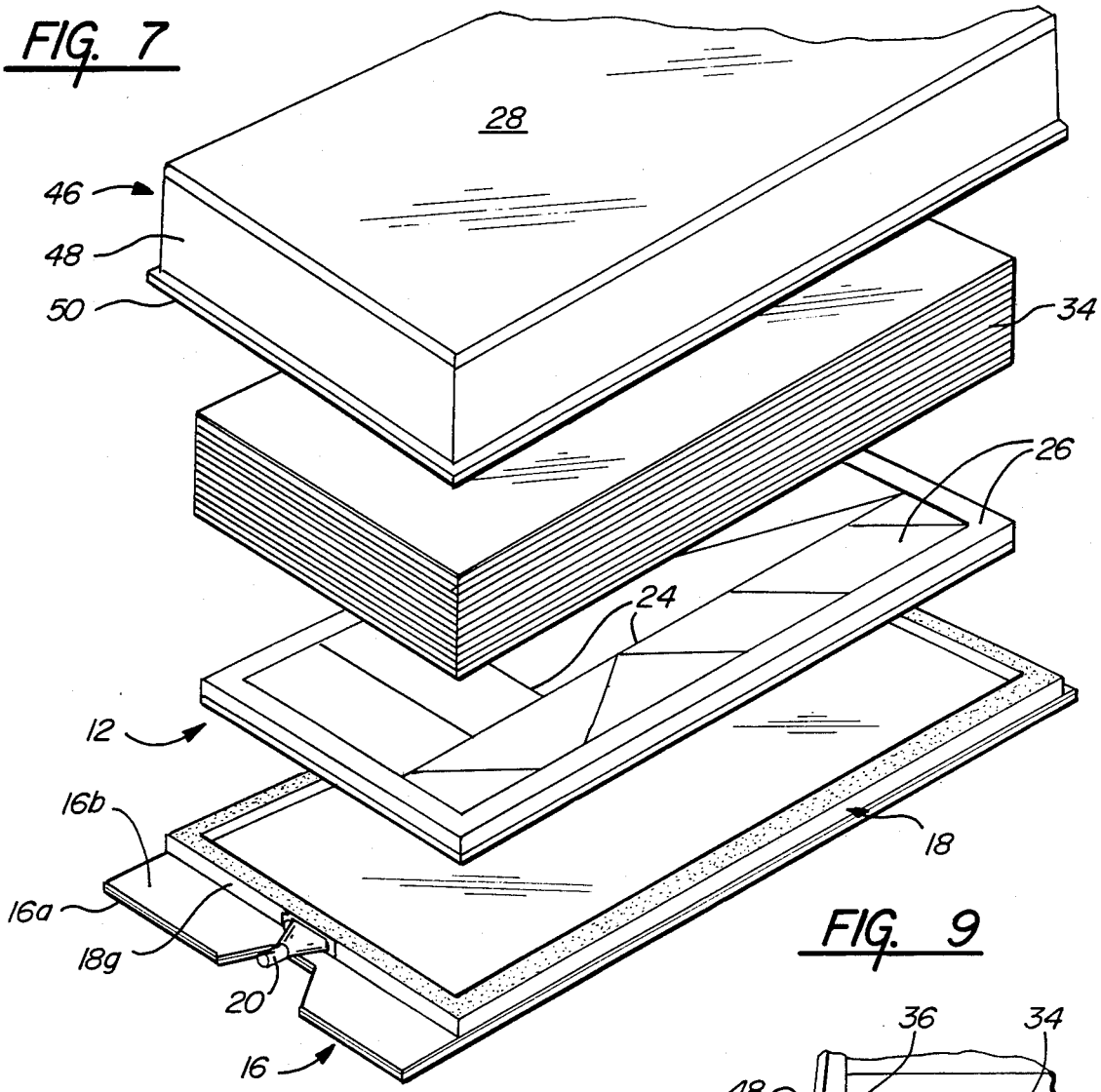
FIG. 9
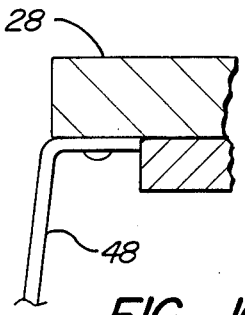
FIG. 10
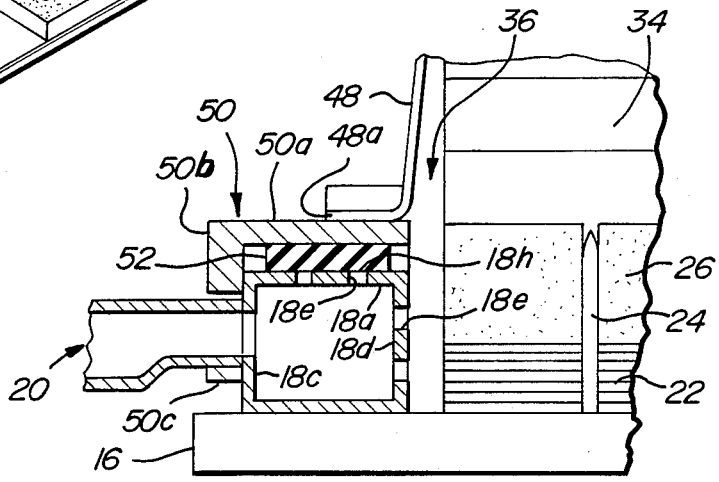
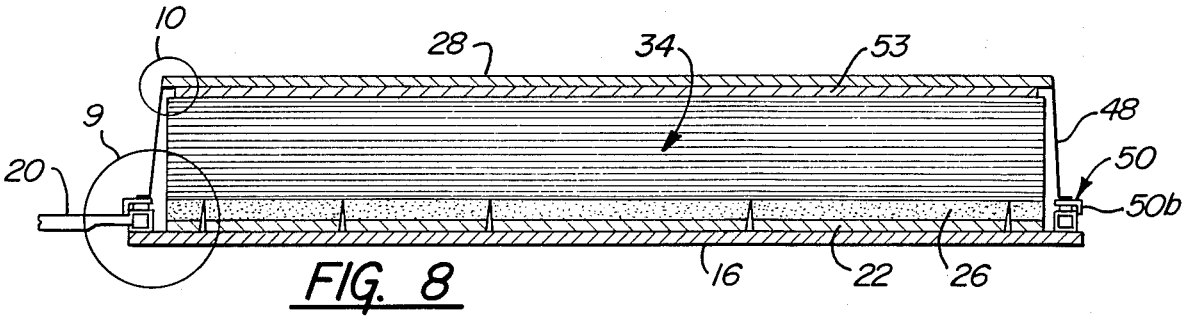
FIG. 8

FIG. 11
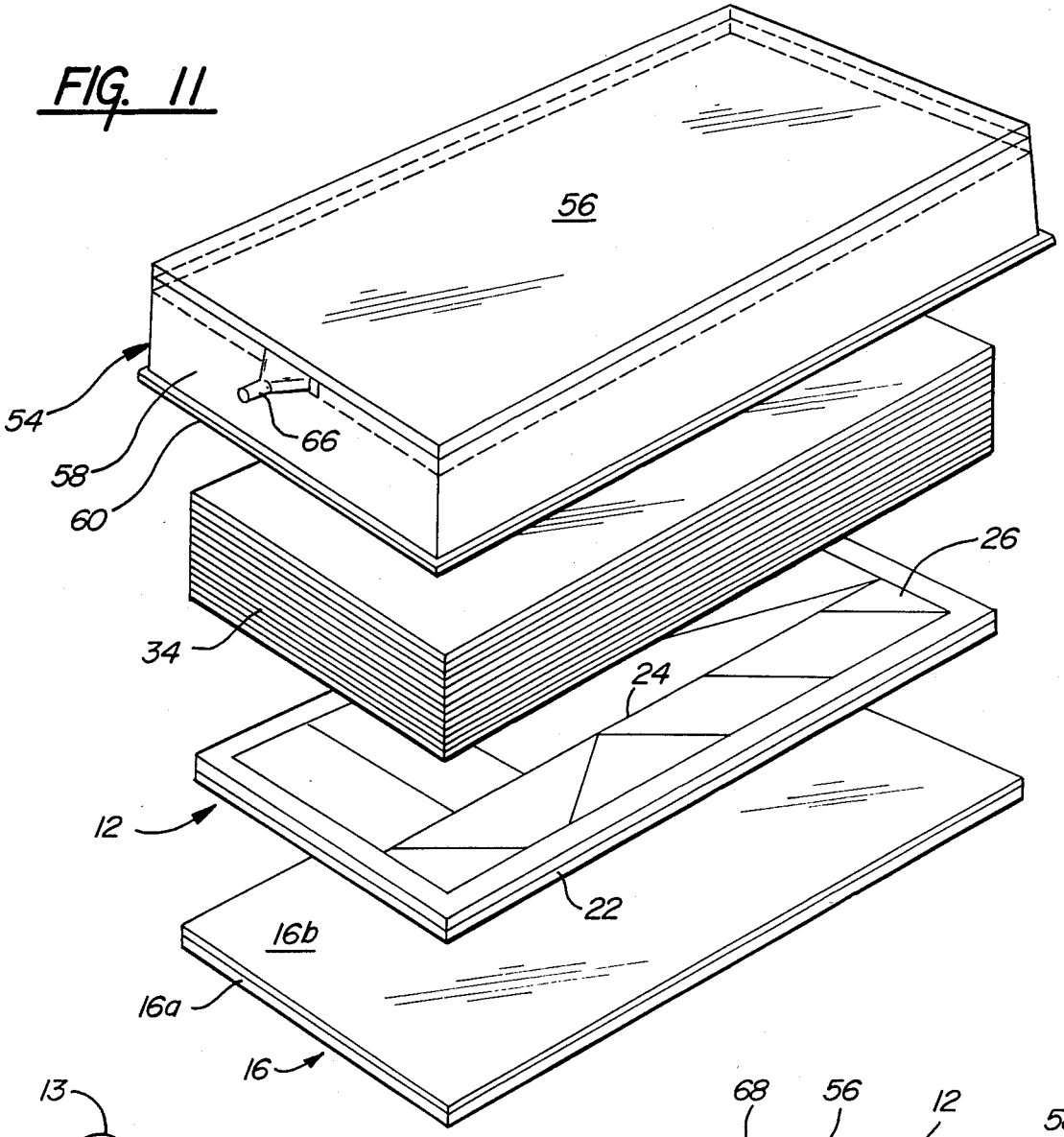
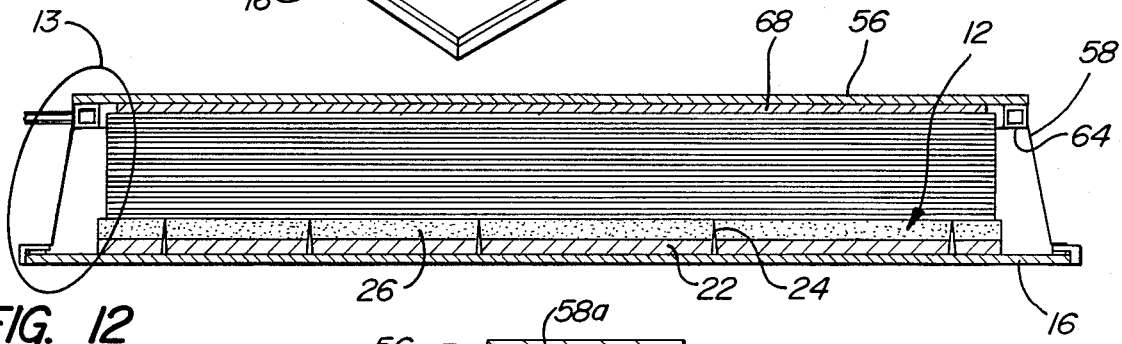
FIG. 12
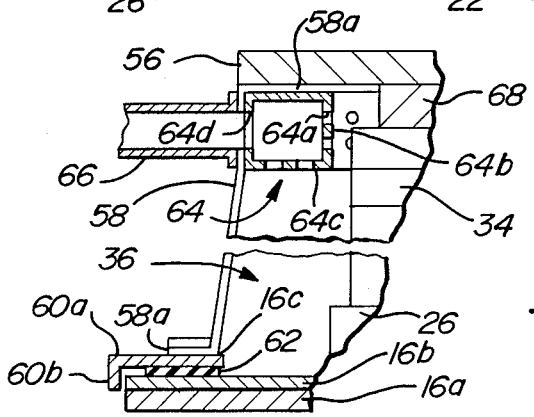
FIG. 13

VACUUM DIE CUTTING METHOD AND APPARATUS

BACKGROUND OF THE INVENTION

This invention relates to steel rule die cutting and particularly to a method and apparatus for cutting single and stacked layers of compressible steel rule die.

Steel rule dies are commonly used for cutting cloth and clothlike materials such as natural textiles, and synthetic materials such as vinyl. Steel rule dies are particularly advantageous in the repetitive cutting of specific shapes such as shirt collars, automobile interior panels and the like. In brief, a steel rule die typically comprises a base or backing board in which a groove matching the pattern to be cut is formed, and a length of steel rule embedded in the board with a sharpened exposed edge extending upwardly therefrom. The die is used in combination with a cutting table and a press which may either be single-cut or progressive feed.

A problem arises when it is necessary or desirable to cut relatively thick but compressible materials such as foam-backed vinyl, foam rubber, and plastic foam. A stack or a particularly thick single layer of such material is sufficiently unstable that an accurate cut is often not possible using conventional techniques.

One approach to the more accurate cutting of foam materials is disclosed in U.S. Pat. Nos. 3,790,154, 3,765,289 and 3,815,221, all assigned to Gerber Garment Technology, Inc. of East Hartford, Conn. These patents, and other related patents assigned to Gerber, disclose a vacuum table which is used primarily to hold sheet material in place while it is cut by a two-axis single blade jigsaw type cutter. According to these patents, a sheet of Mylar or other air impervious material can be placed over a stack of compressible materials such that the vacuum table creates a vacuum under the sheet to pull downwardly on the sheet and maintain the entire stack in a stable, compressed condition during the cutting process. In a further Gerber U.S. Pat., No. 4,060,016, the jigsaw type cutter is replaced by a rotatable turret carrying a plurality of blanking dies which are selectively rotated into position and driven downwardly through an air impervious sheet and through the stacked materials to form a stack of cut patterns corresponding to the shape of the particular die selected.

In all of these patented systems the board on which the stacked material is located must be capable of receiving the penetrations of the reciprocating knife as well as maintaining a vacuum for the principal purpose of holding the stack in place and for the secondary purpose of evacuating the volume under the air impervious sheet.

All of these patented arrangements also suffer from the disadvantage that the air impervious sheet is cut in the process of cutting the stacked material layers with consequent loss of vacuum and thereby a loss of stability of the stack. And whereas certain of the Gerber patents describe means for "healing" the cut in the air impervious sheet behind the cutting member, these healing arrangements unduly complicate the overall cutting apparatus and/or are not totally successful in preventing loss of vacuum with a consequent loss of stability of the stack.

It has been proposed to use steel rule blanking or cutting dies with air evacuation compression so as to facilitate and improve the use of such dies to cut compressible materials. These proposals have involved the use of an air impervious cover or shroud positioned over a stack of compressible material positioned on the steel rule upper edge to define a vacuum chamber, and means for evacuating the vacuum chamber to compress and reduce the thickness of a stack of layers before cutting the layers with the rule. Such an arrangement is shown in U.S. Pat. No. 4,543,862 assigned to the assignee of the present application. Whereas the method and apparatus disclosed in U.S. Pat. No. 4,543,862 is generally satisfactory for the cutting of compressible materials and has achieved significant commercial acceptance, the procedure of this patented process, whereby a large shroud of air impervious material is positioned over the stack of compressible material to form the vacuum chamber, is labor intensive and therefore contributes significantly to the overall cost of the process. Further, the shroud tends to wear with repeated usage and must eventually be replaced with the result that the materials cost of the process is thereby increased.

SUMMARY OF THE INVENTION

This invention is directed toward the provision of an improved steel rule die assembly utilizing air evacuation techniques.

More specifically, the present invention is directed to the provision of a steel rule die employing air evacuation techniques in which the labor and material costs of the process are minimized.

More specifically, the present invention is directed to the provision of a steel rule die, air evacuation process of the type disclosed in U.S. Pat. No. 4,543,862 in which the shroud of the patented process is eliminated with consequent labor and material savings.

According to the invention method, a generally planar support structure is provided; an upwardly facing cutting edge is provided on the support structure; a layer of compressible material is positioned over the cutting edge; an enclosure is formed over the layer of material and over the cutting edge with the enclosure including a top wall overlying the layer of material and collapsible side walls extending between the top wall and the support structure in circumferentially surrounding relation to the cutting edge and to the layer of material to define a sealed vertically collapsible chamber totally enclosing the cutting edge and the layer of material; air is evacuated from the sealed chamber to vertically collapse the side walls of the enclosure to an extent to vertically compress the layer of material and substantially reduce its vertical thickness and to press the compressed reduced thickness layer of material downwardly against the cutting edge; and the cutting edge is moved through the compressed reduced thickness layer of material by a cutting press to cut a fixed pattern in the material corresponding to the shape of the cutting edge. This arrangement retains all of the inherent advantages of the process of Pat. No. 4,453,862 while eliminating the shroud of that process and thereby eliminating the labor and material expenses associated with the shroud.

According to a further feature of the invention method, a closed loop peripheral upwardly facing sealing area is defined on the support structure around the cutting edge; the enclosure side walls are permanently secured to and extend downwardly from the enclosure top wall to form a unitary enclosure; and the sealed chamber is formed by positioning the unitary enclosure over the layer of material with the lower peripheral edges of the enclosure side wall sealingly engaging the closed loop sealing surface on the support structure. This arrangement allows the unitary enclosure to be readily positioned over the stacked layers of material by a single operator and allows the unitary enclosure to be used for repeated cutting operations without derogation of the enclosure.

In one embodiment of the invention method, the side walls of the enclosure are formed of a coated open cell material which collapses in response to evacuation of air from the chamber. This open cell construction provides an efficient and inexpensive means of providing the invention enclosure.

According to a further feature of this embodiment of the invention method, the outer surfaces of the side walls of the enclosure are coated with an air impervious material. This arrangement precludes inward movement of air through the side walls and into the vacuum chamber so as to maximize the effectiveness of the evacuation process.

In another embodiment of the invention method, the enclosure side walls comprise a curtain of flexible sheet material which collapses in response to evacuation of air from the chamber. This arrangement provides a further efficient and inexpensive means of providing the invention enclosure.

According to a further feature of this embodiment of the invention method, an annular rigid frame is secured to the lower edge of the curtain and sealingly engages with the closed loop sealing surface defined on the support structure around the cutting edge. The rigid frame coacts with the top wall to provide definition for the enclosure and provides a means of sealingly engaging the upwardly facing closed loop sealing surface on the support structure. The frame preferably has an angled cross-sectional configuration so that the frame may snuggle around the support structure defining the closed loop sealing surface.

According to a further feature of this embodiment of the invention method, a layer of resilient material is secured to the underface of the rigid frame. This arrangement facilitates the sealing engagement of the frame with the closed loop sealing surface to ensure the integrity of the vacuum chamber.

The invention apparatus comprises a generally planar support structure; a cutting edge extending upwardly from the support structure and adapted to have the compressible material positioned thereon; enclosure means including a top wall overlying the compressible material to be cut and compressible side walls extending between the top wall and the support structure in circumferentially surrounding relation to the cutting edge and to the overlying material to be cut and coacting with the support structure and the top wall to form a sealed, vertically collapsible chamber totally enclosing the cutting edge and the material to be cut; and means for evacuating air from the chamber to collapse the side walls and collapse the chamber to an extent to vertically compress the material and press the compressed material downwardly against the cutting edge. This arrangement provides an efficient and extremely cost effective apparatus for cutting the layers of compressible material on a suitable cutting press.

According to a further feature of the invention apparatus, the support structure defines a closed loop upwardly facing sealing surface in circumferentially surrounding relation to the cutting edge and the side walls of the enclosure means are secured to and extend downwardly from the top wall of the enclosure means for releasable sealing engagement at their lower peripheral edges with the closed loop sealing surface to define the sealed chamber.

According to a further feature of the invention apparatus, the apparatus further includes a closed loop tubular member positioned within the chamber with the lower peripheral edges of the side walls of the enclosure means sealingly engaging the closed loop sealing surface; the walls of the tubular member within the chamber are perforated; and the evacuating means comprises means for drawing air out of the tubular member and thereby out of the chamber.

In one embodiment of the invention apparatus, the tubular member is positioned on the support surface in surrounding relation to the cutting edge and the closed loop upwardly facing sealing surface is defined on the upper face of the closed loop tubular member.

In another embodiment of the invention apparatus, the tubular member is positioned beneath and around the periphery of the top wall within the curtain.

According to a feature of one embodiment of the invention apparatus, the side walls of the enclosure means are formed of an open cell material which collapses in response to evacuation of air from the chamber. According to a further feature of this embodiment, the outer surfaces of the open cell side walls are coated with -an air impervious material to preclude movement of air through the side walls into the chamber.

According to a feature of another embodiment of the invention apparatus, the enclosure side walls comprise a curtain of flexible sheet material which collapses in response to evacuation of the chamber.

According to a further feature of this embodiment of the invention apparatus, a rigid closed loop frame, preferably having an angled cross-sectional configuration, is secured to the lower edge of the curtain and sealingly engages with the closed loop sealing surface.

According to a further feature of this embodiment of the invention apparatus, a layer of resilient material is secured the underface of the rigid frame to facilitate the sealing engagement of the frame with the closed, loop sealing surface.

BRIEF DESCRIPTION OF THE DRAWINGS

FIG. 7 is an exploded perspective view of a further modified form of the invention die cutting apparatus;

FIG. 8 is a longitudinal cross-sectional view of the die cutting apparatus of FIG. 7 showing the material in its condition prior to compression;

FIGS. 9 and 10 are detailed views taken respectively within the circles 9 and 10 of FIG. 8;

FIG. 11 is an exploded perspective view of a still further modified form of the invention die cutting apparatus;

FIG. 12 is a longitudinal cross sectional view of the die cutting apparatus of FIG. 11 showing the material in its condition prior to compression; and FIG. 13 is a detailed view within the circle 13 of FIG. 12.

DETAILED DESCRIPTION OF THE PREFERRED EMBODIMENTS

Figure 1:
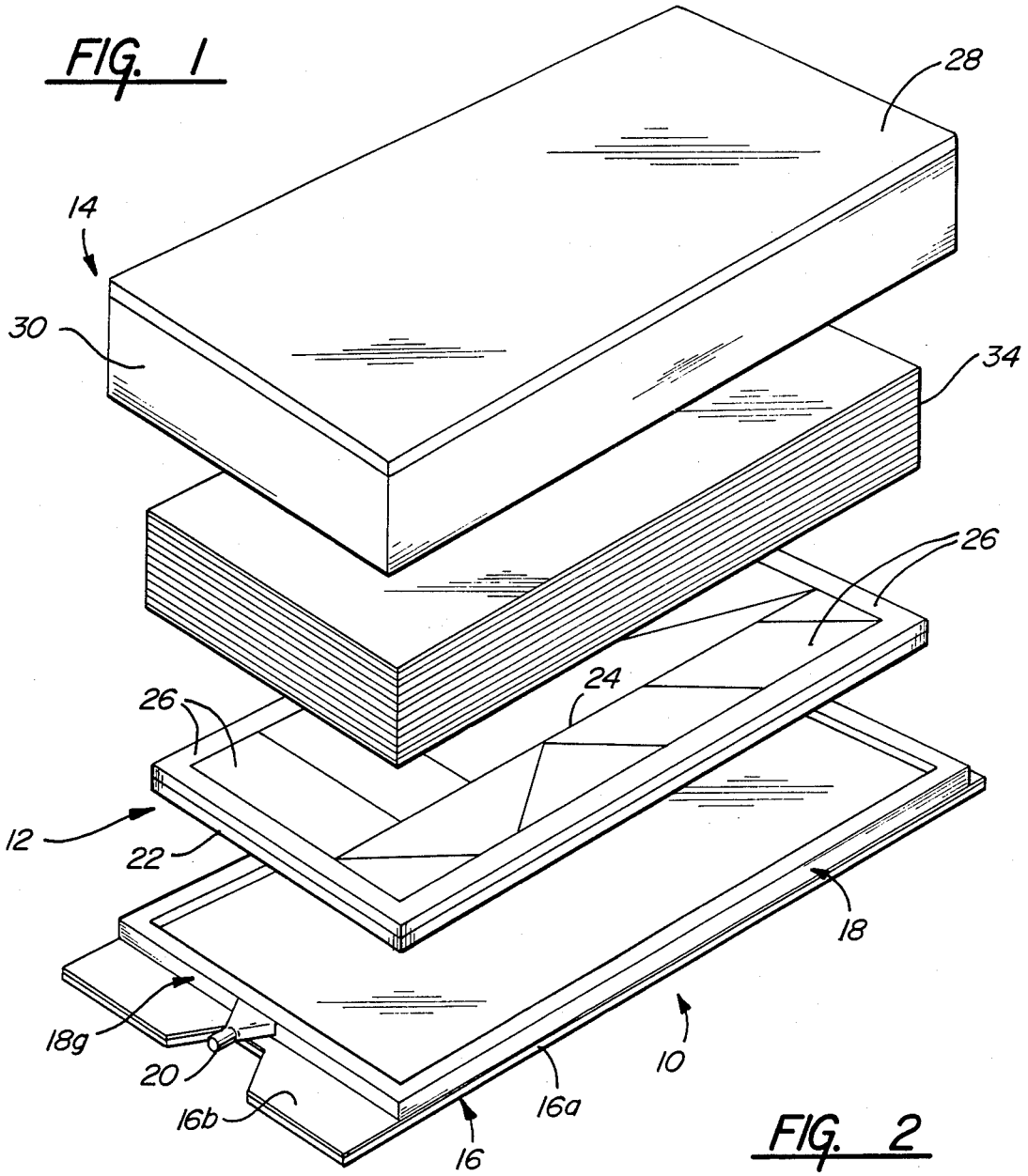
FIG. 1 is an exploded perspective view of a steel rule die cutting apparatus according to the invention.

Referring to the drawings, the invention apparatus, broadly considered, includes a support structure or carrier 10, a steel rule die assembly 12, and an enclosure 14.

Support structure 10 includes a base plate 16 of elongated generally rectangular configuration and a tubular fence 18.

Base plate 16 is laminar and may be formed, for example, of a lower ⅜inch thick polypropylene Plate 16*a* suitably bonded to an upper ⅛inch thick steel plate 16*b*.

Tubular fence 18 is of generally rectangular configuration and extends around the perimeter of base plate 16. Tubular fence 18 is preferably formed of a metallic material and is generally rectangular in transverse cross section. The lower and outer peripheral walls 18*b* and 18*c* of tubular fence 18 are imperforate and the upper and inner walls 18*a* and 18*d* are provided with perforations 18*e*. A tubular spout 20 communicates with an opening 18*f* in the outer wall 18*c* of the tubular fence so as to provide communication between the interior of the spout and the interior of the tubular member.

Steel rule die assembly 12 includes a die board 22, a steel rule 24 and foam members 26.

Die board 22 may be formed of ⅝ inch thick beechwood, birch, maple, or suitable plywood and has a generally rectangular configuration sized to fit loosely within the inner perimeter of tubular fence 18.

Steel rule 24 extends upwardly from die board 22 and has an overall configuration corresponding to the desired shape to which the compressible material is to be cut. Steel rule 24 is driven at its lower edge portions into slots 22*a* provided in die board 22 and presents a sharpened upper exposed edge 24*a*.

Foam members 26 have an open cell construction and are configured to fill the areas defined between the various sections of the steel rule die 24 as well as the areas between the outer peripheral surfaces of the steel rule die and the peripheral edges of die board 22. Foam members 26 are of a thickness generally corresponding to the height to which the steel rule die portions 24 extend above the upper surface of die board 22 so that the upper surfaces of foam members 26 are substantially flush with the cutting edges of the steel rule die sections.

Enclosure 14 includes a top wall member 28 and side wall members 30.

Top wall member 28 is formed of a suitable rigid plastic material which is penetrable by the steel rule die 24. Top wall member 28 has a rectangular configuration generally conforming to the configuration of base plate 16.

Side wall members 30 are formed of a soft open cell material and are coated on their outside surfaces 30*a* and on their lower peripheral edges 30*b* with an air impervious flexible coating 32 such, for example, as a suitable urethane coating. The upper peripheral edge portions of side wall members 30 are suitably secured, as by gluing, to the peripheral undersurfaces of top wall 30 and extend downwardly from top wall 30 to form a unitary enclosure therewith. Side wall members 30 have a height generally corresponding to the height of the stack of material layers to be cut. The lower peripheral edges 30*b* of side wall members 30 form a closed loop downwardly facing sealing surface 30*c* having a size and configuration generally conforming to an upwardly facing closed loop sealing surface 18*h* defined by the upper surface of upper wall portion 18*a* of tubular fence 18.

Figure 2:
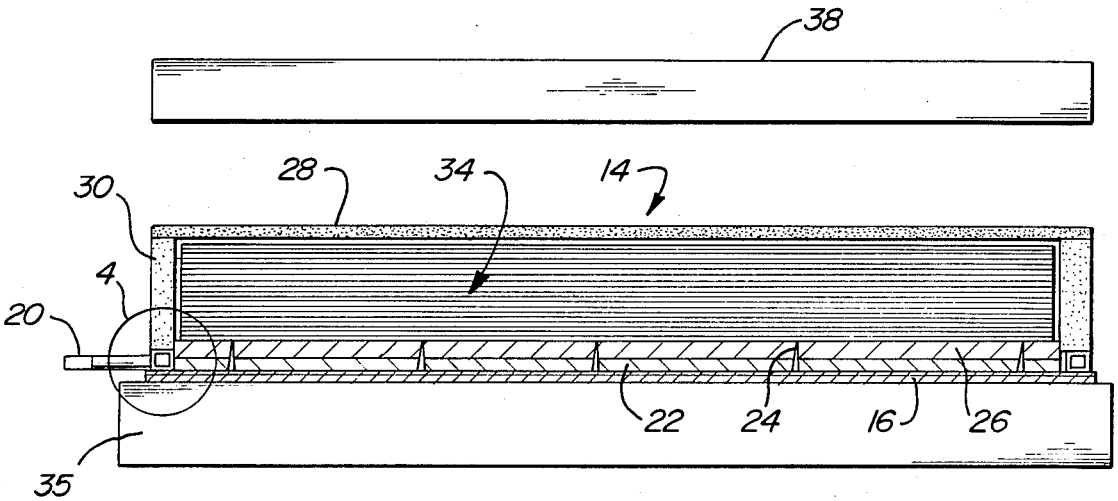
FIG. 2 is a longitudinal cross-sectional view of the invention steel rule die cutting apparatus showing the condition of the material to be cut before compression.
Figure 3:
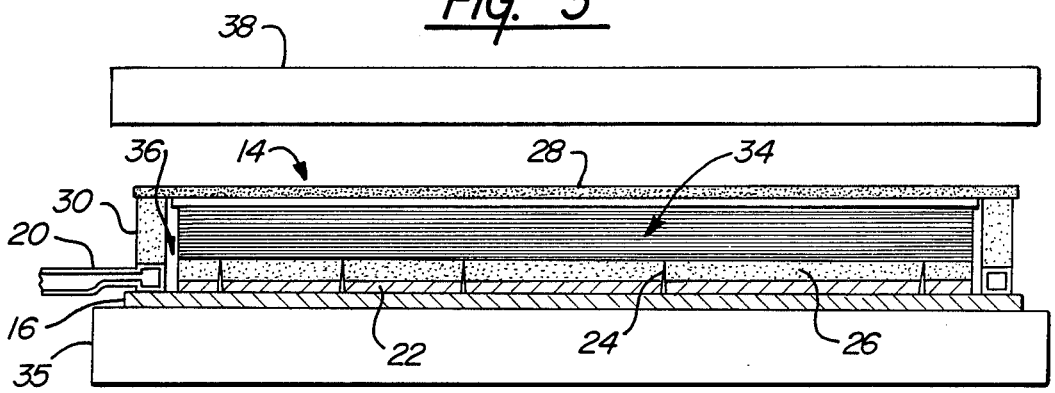
FIG. 3 is a longitudinal cross-sectional view showing the materials after compression.
Figure 4:
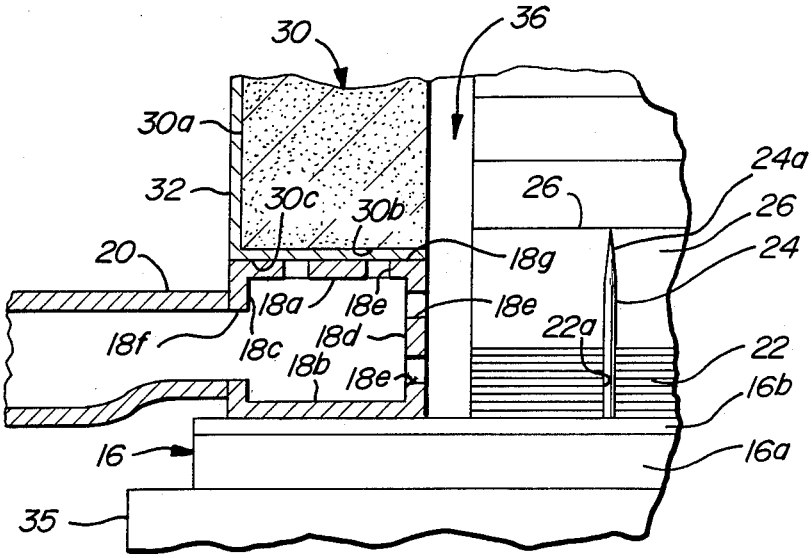
FIG. 4 is a detailed view within the circle of FIG. 2.
Figure 6:
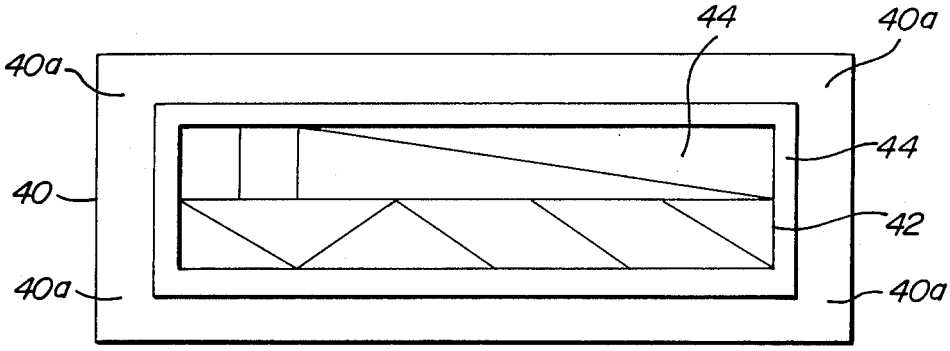
FIG. 6 is a plan view of a steel rule die employed in the apparatus of FIG. 5.

In operation, support structure 10 is positioned on the base or lower platen 35 of a suitable cutting press steel die assembly 12 is positioned on base plate 16 within tubular fence 18; a plurality of layers 34 of compressible foam materials or other high pile or spongy fabrics having a size and configuration generally corresponding to the size and configuration of the steel rule die assembly are positioned on top of the steel rule die assembly with the lower surface of the stack resting on the upper surface of the foam members 26 in contiguous relation to the sharpened upper edges of the steel rule die 24; enclosure 14 is positioned over the stacked material layers with the side walls 30 positioned in circumferentially surrounding relation to the material stack 34 and with sealing surface 30*c* sealingly engaging closed loop sealing surface 18*g* to define a sealed, vertically collapsible chamber 36; air is evacuated from the chamber 36 by withdrawing air outwardly through perforations 18*e* in tubular fence inner wall 18*d*, the tubular interior of tubular fence 18, and spout 20 to vertically compress the stack 34 of material and substantially reduce its vertical thickness and to press the compressed reduced thickness layer of material downwardly against the sharpened upper edge of steel rule die 24; and the upper platen 38 of the associated press is lowered in known manner to move the cutting edges of the steel rule die through the compressed reduced thickness layer of material to cut a fixed pattern in the material corresponding to the composite shape of the steel rule die. The perforations 18*e* in the tubular fence upper wall 18*a* act during the evacuation and cutting process to augment the sealing engagement of sealing surface 30*c* with sealing surface 18*g*. The height of the stack of material prior to evacuation of chamber 36 is seen in FIG. 2 and the compressed height of the stack following evacuation of chamber 36 is seen in FIG. 3. Following the cutting operation, upper platen 38 is raised, the cut material is removed, a new stack of material to be cut is positioned over the steel rule die assembly, enclosure 14 is positioned over the new stack of material, and the cutting operation is repeated.

Figure 5:
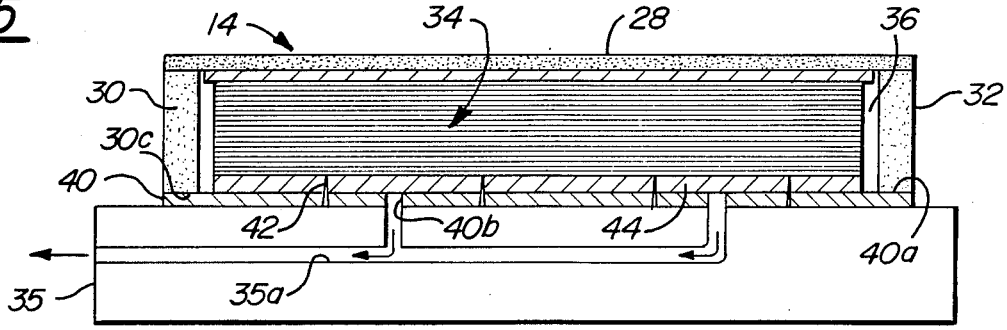
FIG. 5 is a longitudinal cross-sectional view showing a modified form of the invention die cutting apparatus.

In the modified apparatus seen in FIG. 5, the apparatus comprises a support structure in the form of a die board 40, a steel rule die 42 extending upwardly from die board 40 to define the desired cutting pattern, a plurality of open cell plastic foam members 44 positioned in the spaces between the sections of the steel rule die and around the outer peripheral surfaces of the steel rule die, and an enclosure 14 including a top wall 28 and side walls 30 provided on their outer surfaces and lower edges with an air impervious coating 32. In this embodiment, the lower peripheral edges 30*c* of the side wall members 30 sealingly coact with a closed loop upwardly facing sealing surface 40*a* defined around the upper perimeter of die board 40, and air is withdrawn from the steel chamber 36 through a vacuum passage 35*a* in lower platen 35 communicating with slots 40*b* in die board 40.

Material 34 to be cut is positioned over the steel rule die, enclosure 14 is positioned over the stacked material with the lower peripheral edge 30*c* of the side walls of the enclosure sealingly coacting with the closed loop upwardly facing sealing surface 40*a* defined on die board 40, air is withdrawn from chamber 36 by drawing air downwardly through open cell foam members 44, through slots 40*b* and through passages 35*a* to vertically compress the stack 34 and to press the compressed reduced thickness stack downwardly against steel rule 42, and upper platen 38 is lowered to perform the cutting operation. Following the cutting operation, the enclosure 14 is lifted, the cut pieces are removed, a new stack of layers to be cut is positioned over the steel rule die assembly, and the enclosure is again put in position over the layers of material preparatory to a new cutting operation.

In the modified apparatus seen in FIGS. 7–10, the enclosure 46 comprises a top wall member 28, a closed loop curtain 48, and a frame 50.

As with the previous embodiments, top wall member 28 is formed of a suitable rigid plastic material which is penetrable by the steel rule die 24 and has a rectangular configuration generally conforming to the configuration of base plate 16.

Curtain 48 is formed of a flexible impervious sheet material such as rubberized nylon. Curtain 48 is secured along its upper edge to the underface of top wall member 28 by the use of suitable mechanical fasteners or suitable adhesives and depends downwardly from top wall member 28.

Frame 50 is formed of a suitable metallic material, is substantially rigid, and has a rectangular configuration with an angular cross section. Specifically, frame 50 includes a horizontal leg portion 50*a* and a vertical leg portion 50*b*. Horizontal leg portion 50*a* conforms in size and shape to the upper closed loop sealing surface 18*g* defined on the upper surface of tubular member 18. The lower edge of curtain 48 is secured to frame 50 by suitably fastening the lower edge portion 48*a* of the curtain to the upper face of horizontal frame portion 50*a* and a layer 52 of resilient material is secured to the underface of horizontal frame portion 50*a*. Layer 52 may, for example, comprise a suitable rubberized material. Vertical leg portion 50*b* of frame 50 fits snuggly around tubular fence 18 with the inner face of leg portion 50*b* coacting with the confronting outer face of the fence outer wall 18*c* to preclude lateral movement of the frame relative to the fence. A cutout 50*c* in vertical leg 50*b* allows the passage of spout 20.

In the use of the embodiment of FIGS. 7–10, material 34 to be cut is positioned over the steel rule die; a disposable rectangular cutting pad 53 is positioned on top of the stacked material; enclosure 46 is positioned over the stacked material and over pad 53 with the curtain 48 surrounding the stacked material and layer 52 sealingly coacting with the closed loop upwardly facing sealing surface 18*h*; air is withdrawn from chamber 36 by drawing air downwardly through the stacked layers 34, through open cell foam members 26, and through tubular member 18 for discharge through spout 20 to vertically compress the stack 34 and press the compressed reduced thickness stack downwardly against steel rule 24; and the upper platen, of the press is lowered to perform the cutting operation. Following the cutting operation, enclosure 48 is lifted, pad 53 is removed, the cut pieces are removed, a new stack of layers to be cut is positioned over the steel rule die assembly, pad 53 is positioned over the new stack, and the enclosure is again put in position over the layers of material preparatory to a new cutting operation. It will be understood that cutting pad 53 is utilized beneath top member 28 to protect the top member from the cutting action of the steel rule die.

In the modified apparatus seen in FIGS. 11–13, the enclosure 54 comprises a top wall member 56, a closed loop curtain 58, and a frame 60. Top wall member 56 is formed of a suitable rigid plastic material which is penetrable by the steel rule die 24 and has a rectangular configuration generally conforming to the configuration of base plate 15.

Curtain 58 is formed of a flexible impervious sheet material such as rubberized nylon. Curtain 58 is secured along its upper edge 58*a* to the underface of top wall member 56 by the use of suitable mechanical fasteners or suitable adhesives and depends downwardly from top wall member 56.

Frame 60 is formed of a suitable metallic material, is substantially rigid, and has a rectangular configuration with an angular cross section. Specifically, frame 60 includes a horizontal leg portion 60*a* and a vertical leg portion 60*b*. Horizontal leg portion 60*a* conforms in size and shape to a closed loop sealing surface 16*c* defined on the upper surface of upper steel plate 16*b* of base plate 16 around the steel rule die assembly 12. The lower edge 58*a* of curtain 58 is suitably secured to the upper face of horizontal frame portion 60*a* and a layer of resilient material 62 is secured to the underface of horizontal frame portion 60*a*. Layer 62 may for example comprise a suitable rubberized material. Vertical leg portion 60*b* fits snuggly around the periphery of plate 16 to preclude lateral movement of frame 60 relative to plate 16.

The apparatus of FIGS. 11–13 further includes a closed loop tubular member 64 which is positioned beneath and around the periphery of top wall 56 with the curtain 58. Tubular member 64 may be secured to the underperiphery of top wall 56 by the use of adhesives or mechanical fasteners. Tubular member 64 includes perforations 64*a* in its inner and bottom wall portions 64*b* and 64*c*, and a tubular spout 66 communicates with an opening 64*d* in the outer wall of tubular member 64 to provide communication between the interior of the spout and the interior of the tubular member.

In the use of the embodiment of FIGS. 11–13, material 34 to be cut is positioned over the steel rule die; a cutting pad 68 is positioned over stacked material 34; enclosure 54 is positioned over the stacked material with the curtain 58 surrounding the stacked material and layer 62 sealingly coacting with closed loop upwardly facing sealing surface 16*c*; air is withdrawn from chamber 36 by drawing air outwardly through perforations 64*a*, through the hollow interior of tubular member 64, and through spout 66 to vertically compress the stack 34 and press the compressed reduced thickness stack downwardly against steel rule 24; and the upper platen of the press is lowered to perform the cutting operation. Following the cutting operation, enclosure 54 is lifted, the cut pieces are removed, a new stack of layers to be cut is positioned over the steel rule die assembly, and the enclosure is again put in position over the layers of material preparatory to a new cutting operation.

In all of the disclosed embodiments, the enclosure may be lifted in and out of position over the stacked layers by a single operator using conventional suction cup lift assist mechanisms and the enclosure may be used over and over again for repeated cutting operations. The invention method and apparatus thus retains all of the advantages of the method and apparatus disclosed in U.S. Pat. No. 4,543,862 but additionally significantly reduces the labor and material costs as compared to the method and apparatus of that patent.

Whereas preferred embodiments of the invention have been illustrated and described in detail, it will be apparent that various changes may be made in the disclosed embodiments without departing from the scope or spirit of the invention.

We claim:

1. A method of cutting compressible materials comprising:

(A) providing a generally planar support structure;

(B) providing an upwardly facing cutting edge on said support structure and an upwardly facing closed loop sealing surface on said support structure in surrounding relation to said cutting edge;

(C) positioning a layer of compressible material over said cutting edge;

(D) forming an enclosure over said layer of material and over said cutting edge including a rigid top wall overlying said layer of material, collapsible side walls extending between said top wall and said support structure in circumferentially surrounding relation to said cutting edge and to said layer of material, and a rigid closed loop frame member secured to the lower edge of said side walls and sealingly coacting with said closed loop sealing surface to define a sealed, vertically collapsible chamber totally enclosing said edge and said layer of material;

(E) evacuating air from said chamber to vertically collapse said side walls to an extent to vertically compress said layer of material and substantially reduce its vertical thickness and to press said compressed reduced thickness layer of material downwardly against said edge; and (F) moving said cutting edge through said compressed reduced thickness layer of material to cut a fixed pattern in the material corresponding to the shaped of the cutting edge.

2. A method according to claim 1 wherein:

(G) said cutting edge is provided by a steel rule die assembly including a die board and a steel rule defining said cutting edge;

(H) said closed loop peripheral upwardly facing sealing surface is defined on said die board around said steel rule;

(I) said enclosure side walls are secured to and extend downwardly from said enclosure top wall; and (J) said sealing chamber is formed by positioning said enclosure over said layer of material with the lower peripheral edges of said frame member sealingly engaging said closed loop sealing surface on said die board.

3. A method according to claim 1 wherein:

(G) the air is evacuated from said chamber by withdrawing air from the lower side of said chamber.

4. A method according to claim 1 wherein:

(G) said enclosure side walls comprise a closed loop curtain of flexible air impervious sheet material which collapses in response to evacuation of said chamber.

5. A method according to claim 4 wherein:

(H) said flexible air impervious sheet material comprises a rubberized material.

6. A method according to claim 4 wherein:

(I) said rigid frame member is secured to the lower edge of said curtain and sealingly engages with said closed loop sealing surface.

7. A method according to claim 6 wherein:

(J) a layer of resilient material is secured to the underface of said rigid frame member to facilitate the sealing engagement of said frame member with said closed loop sealing surface.

8. A method according to claim 1 wherein:

(H) said frame member has an angular cross section including a horizontal leg portion sealing engaging said closed loop sealing surface and a depending skirt portion positioned in surrounding relation to said support structure.

9. A method of cutting compressible materials comprising:

(A) providing a steel rule die assembly including a die board and a steel rule and including an upwardly facing closed loop sealing surface defined on said die board in surrounding relation to said cutting edge;

(B) positioning a layer of compressible material over said cutting edge;

(C) forming an enclosure over said layer of material and over said cutting edge including a rigid top wall overlying said layer of material and collapsible side walls extending between said top wall and said support structure in circumferentially surrounding relation to said cutting edge and to said layer of material and coacting at their lower edges with said sealing surface on said die board to define a sealed vertically collapsible chamber totally enclosing said edge and said layer of material;

(E) evacuating air from said chamber to vertically collapse said side walls to an extent to vertically compress said layer of material and substantially reduce its vertical thickness and to press said compressed reduced thickness layer of material downwardly against said edge; and (F) moving said cutting edge through said compressed reduced thickness layer of material to cut a fixed pattern in the material corresponding to the shape of the cutting edge.

10. An apparatus for cutting compressible materials comprising:

(A) a generally planar support structure;

(B) a cutting edge extending upwardly from said support structure and adapted to have the compressible material to be cut positioned thereon;

(C) means defining an upwardly facing closed loop sealing surface on said support structure in surrounding relation to said cutting edge;

(D) enclosure means including a rigid top wall overlying the compressible material to be cut, collapsible side wall extending between said top wall and said support surface in circumferentially surrounding relation to said cutting edge and to the material to be cut, and a rigid closed loop frame member secured to the lower edge of said side walls and sealingly coacting with said closed loop sealing surface to form a sealed vertically collapsible chamber totally enclosing said cutting edge and the material to be cut; and (E) means for evacuating air from said chamber to collapse said side walls and collapse said chamber to an extent to vertically compress the material and press the compressed material downwardly against said cutting edge.

11. An apparatus according to claim 10 wherein:
(F) said cutting edge is provided by a steel rule die assembly including a die board and a steel rule defining said cutting edge;
(G) said closed loop upwardly facing sealing surface is defined on said die board in circumferentially surrounding relation to said steel rule; and
(H) said side walls are secured to and extend downwardly from said top wall to position said frame member for releasable sealing engagement at its lower peripheral edge with said closed loop sealing surface to define said sealed chamber.

12. An apparatus according to claim 10 wherein:
(F) a closed loop tubular member is positioned on said support structure in surrounding relation to said cutting edge;
(G) said closed loop upwardly facing sealing surface is defined on the upper face of said closed loop tubular member;
(H) said tubular member is perforated along its inner periphery to provide communication between said chamber and the interior of said tubular member; and
(I) said evacuating means comprises means for drawing air out of said tubular member and thereby out of said chamber.

13. An apparatus according to claim 10 wherein:
(F) said enclosure side walls comprise a curtain of flexible sheet material which collapses in response to evacuation of said chamber.

14. An apparatus according to claim 13 wherein:
(G) said flexible sheet material comprises a rubberized nylon material.

15. An apparatus according to claim 13 wherein:
(G) said apparatus includes a closed loop tubular member positioned within said chamber with the lower peripheral edge of said frame member sealingly engaging said closed loop sealing surface;
(H) the walls of said tubular member within said chamber are perforated; and
(I) said evacuating means comprises means for drawing air out of said tubular member and thereby out of said chamber.

16. An apparatus according to claim 15 wherein:
(J) said tubular member is positioned on said support surface in surrounding relation to said cutting edge; and
(K) said closed loop upwardly facing sealing surface is defined on the upper face of said closed loop tubular member.

17. An apparatus according to claim 15 wherein:
(J) said tubular member is positioned beneath and around the periphery of said top wall within said curtain.

18. An apparatus for cutting compressible materials comprising:
(A) a generally planar support structure defining a closed loop upwardly facing sealing surface;
(B) a cutting edge extending upwardly from said support structure within said closed loop sealing surface and adapted to have the compressible material to be cut positioned thereon;
(C) enclosure means including a top wall overlying the compressible material to be cut and a curtain of flexible sheet material extending between said top wall and said support surface in circumferentially surrounding relation to said cutting edge and the material to be cut;
(D) a closed loop rigid frame secured to the lower edge of said curtain and sealingly coacting with said closed loop sealing surface to form a sealed vertically collapsible chamber totally enclosing said cutting edge and the material to be cut; and
(E) means for evacuating air from said chamber to collapse said curtain and collapse said chamber to an extent to vertically compress the material and press the compressed material downwardly against said cutting edge.

19. An apparatus according to claim 18 wherein:
(F) a layer of resilient material is secured to the underface of said rigid frame to facilitate the sealing engagement of said frame with said closed loop sealing surface.

20. An apparatus according to claim 18 wherein:
(F) said frame has an angular cross section including a horizontal leg portion sealingly engaging said closed loop sealing surface and a depending skirt portion positioned in surrounding relation to said support structure.

21. An apparatus for cutting compressible materials comprising:
(A) generally planar support structure;
(B) a cutting edge extending upwardly forms said support structure and adapted to have the compressible material to be cut positioned thereon;
(C) enclosure means including a top wall overlying the compressible material to be cut and collapsible side walls extending between said top wall and said support surface in circumferentially surrounding relation to said cutting edge and the material to be cut and coacting with said support structure and said top wall to form a sealed vertically collapsible chamber totally enclosing said cutting edge and the material to be cut;
(D) a closed loop tubular member positioned beneath and around the periphery of said top wall within said side walls with the walls of said tubular member within said side wall being perforated; and
(E) means for drawing air out of said tubular member and thereby out of said chamber to collapse said side walls and collapse said chamber to an extent to vertically compress the material and press the compressed material downwardly against said cutting edge.

22. An apparatus for cutting compressible materials comprising:
(A) a steel rule die assembly including a die board and a steel rule defining a cutting edge and defining a closed loop upwardly facing sealing surface on said die board in surrounding relation to said cutting edge;
(B) enclosure means including a rigid top wall overlying the compressible material to be cut and collapsible side walls extending between said top wall and said support surface in circumferentially surrounding relation to said cutting edge and to the material to be cut and sealingly coacting with said closed loop sealing surface on said die board to form a sealed vertically collapsible chamber totally enclosing said cutting edge and the material to be cut; and
(C) means for evacuating air from said chamber to collapse said side walls and collapse said chamber to an extent to vertically compress the materials downwardly against said cutting edge.

* * * * *